US011053705B2

(12) United States Patent
Yoshino et al.

(10) Patent No.: US 11,053,705 B2
(45) Date of Patent: Jul. 6, 2021

(54) METHOD FOR TOPPLING TOWER BUILDING IN WHICH BASE IS USED

(71) Applicant: BESTERRA CO., LTD., Tokyo (JP)

(72) Inventors: Yoshihide Yoshino, Tokyo (JP); Toshiaki Aoki, Tokyo (JP)

(73) Assignee: BESTERRA CO., LTD., Tokyo (JP)

( * ) Notice: Subject to any disclaimer, the term of this patent is extended or adjusted under 35 U.S.C. 154(b) by 110 days.

(21) Appl. No.: 16/603,077

(22) PCT Filed: Apr. 13, 2017

(86) PCT No.: PCT/JP2017/015087

§ 371 (c)(1),
(2) Date: Oct. 4, 2019

(87) PCT Pub. No.: WO2018/189852

PCT Pub. Date: Oct. 18, 2018

(65) Prior Publication Data

US 2020/0071949 A1 Mar. 5, 2020

(51) Int. Cl.
*E04G 23/08* (2006.01)
*E04H 12/34* (2006.01)

(52) U.S. Cl.
CPC ..... *E04H 12/348* (2013.01); *E04G 23/08* (2013.01); *E04G 2023/087* (2013.01); *Y10T 29/49815* (2015.01)

(58) Field of Classification Search
CPC ..... E04H 12/348; E04H 12/10; E04G 23/08; E04G 2023/087; E04G 23/082; E02D 27/425
See application file for complete search history.

(56) References Cited

U.S. PATENT DOCUMENTS 3,705,747 A * 12/1972 Blackburn ..... E04G 23/082 299/70
4,272,929 A * 6/1981 Hanson ..... F03D 13/20 52/40

(Continued)

FOREIGN PATENT DOCUMENTS

JP S63-122870 A 5/1988
JP 2002-13300 A 1/2002

(Continued)

*Primary Examiner* — Lawrence Averick
(74) *Attorney, Agent, or Firm* — Muncy, Geissler, Olds & Lowe, P.C.

(57) ABSTRACT

To provide a method of toppling a tower structure more safely, simply and quickly than in the conventional manner. In a method of toppling a tower structure that is fixedly supported on a base 20 to demolish the tower structure 10, the method includes a base dividing step of dividing the base 20 into an upper base 22 and a lower base 26, by cutting the base 20 in a substantially horizontal direction, an upper base dividing step of dividing the upper base 22 into a support base portion 23 and a separated base portion 24 by cutting the upper base 22, in a longitudinal direction, from above to a substantially horizontal surface 20*a*, a removing step of removing the separated base portion 24, and a toppling step of toppling the tower structure 10 together with the support base portion 23 using, as a tumble axis 23*a*, a lower edge of a longitudinally cut surface 22*a* of the support base portion 23, in which the tumble axis 23*a* is located on a toppling direction side of the tower structure with respect to a center of gravity C. Thus, since the tumble axis 23*a* of the robust base serves as a tumble fulcrum by itself, there is no possibility that breakage of the base is caused even by the concentration of a buckling load, and the tower structure can be toppled in an intended direction.

6 Claims, 12 Drawing Sheets

(56) References Cited

U.S. PATENT DOCUMENTS 4,880,576 A * 11/1989 Blank ..... C07B 39/00 562/828
5,599,980 A * 2/1997 Marhold ..... B01J 27/10 562/840
5,653,508 A * 8/1997 Carney ..... E04G 23/08 299/15
6,075,165 A * 6/2000 Marhold ..... B01J 27/10 562/859
6,098,907 A * 8/2000 Kato ..... E04G 23/08 241/30
6,467,233 B1 * 10/2002 Maliszewski ..... E04H 12/085 52/831
7,160,085 B2 * 1/2007 de Roest ..... E04H 12/12 416/244 R
7,202,384 B2 * 4/2007 Zechlin ..... C07C 209/68 568/323
2003/0229252 A1 * 12/2003 Zechlin ..... C07C 265/14 564/428
2006/0178526 A1 * 8/2006 Zechlin ..... C07C 209/68 560/347
2009/0249707 A1 * 10/2009 Curme ..... F03D 13/10 52/40
2012/0102850 A1 * 5/2012 Kensinger ..... F16M 11/38 52/111
2012/0248281 A1 * 10/2012 Bennett ..... H01Q 1/1242 248/524
2015/0159388 A1 * 6/2015 Perdue ..... E02F 9/028 241/101.72
2015/0300039 A1 * 10/2015 Yoshino ..... E04G 3/30 29/426.4

FOREIGN PATENT DOCUMENTS

JP 2007-327301 A 12/2007
JP 4790357 B2 10/2011

* cited by examiner

[Fig. 1]
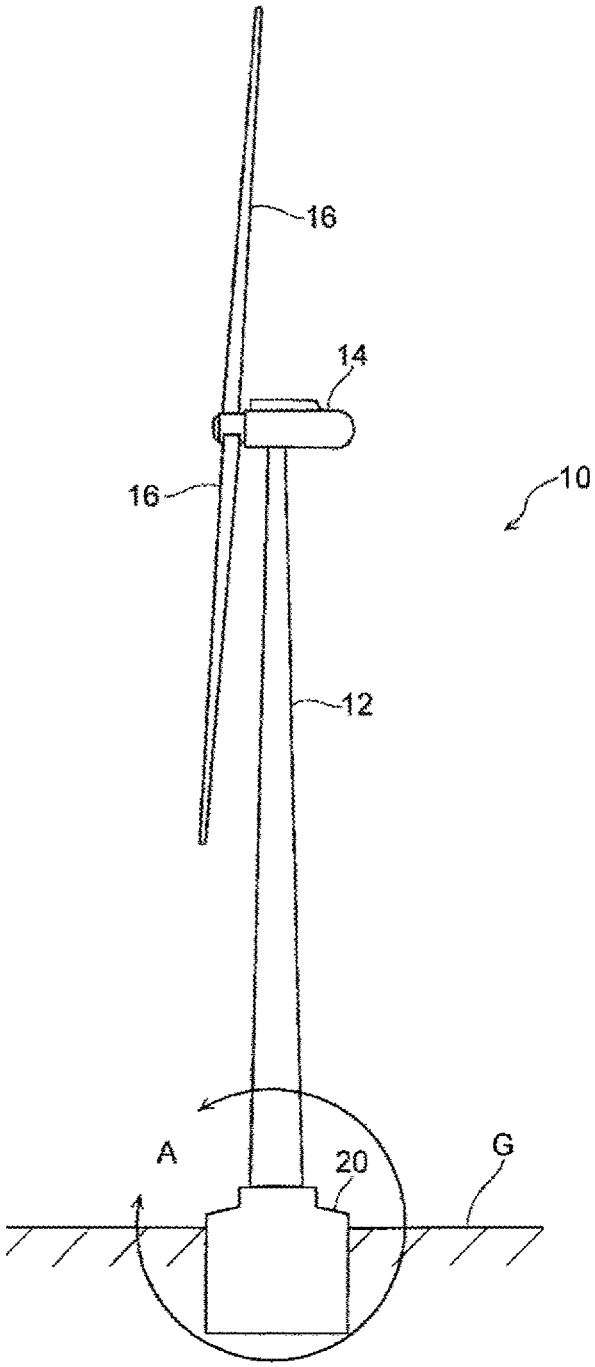

[Fig. 2]
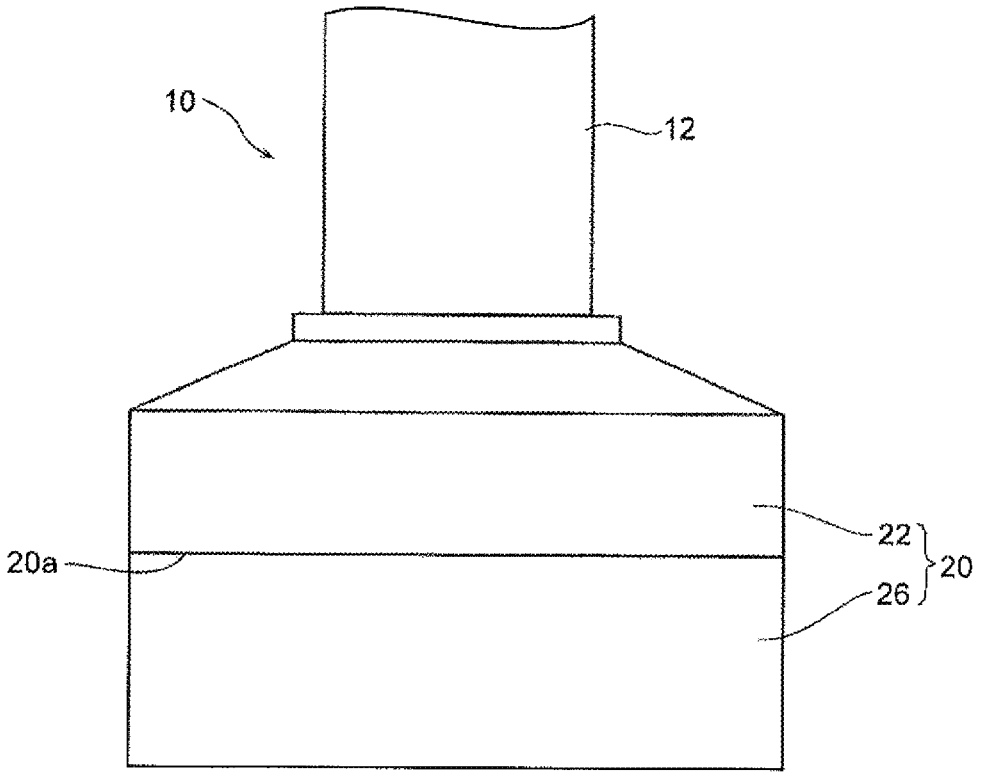

[Fig. 3]
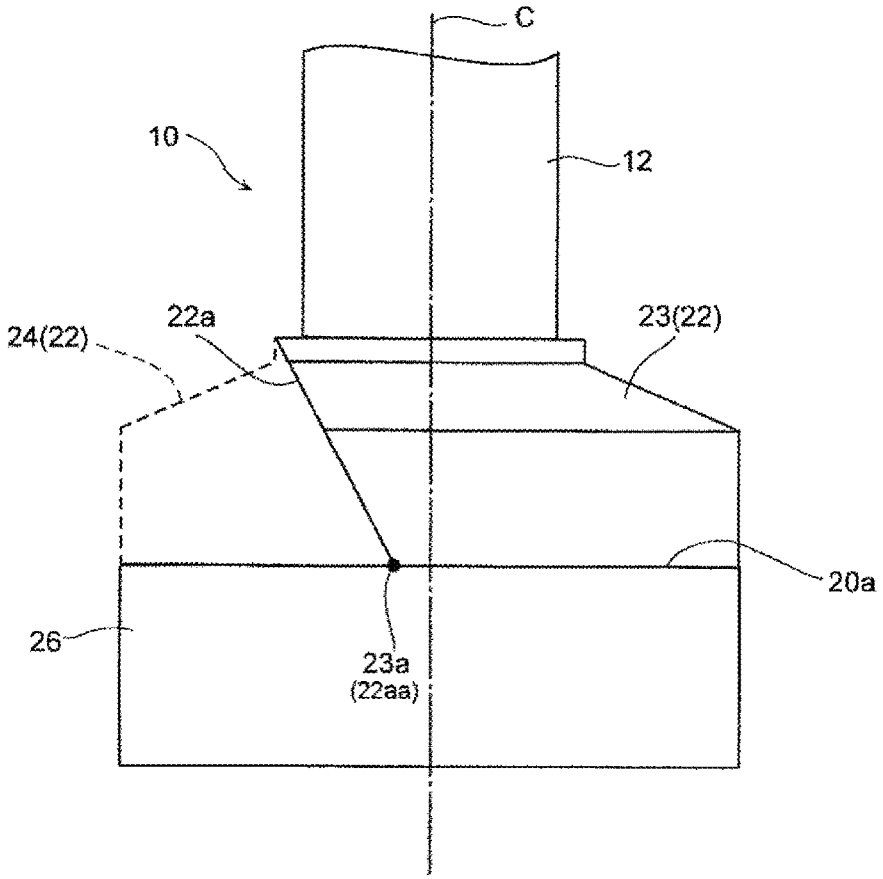

[Fig. 4]
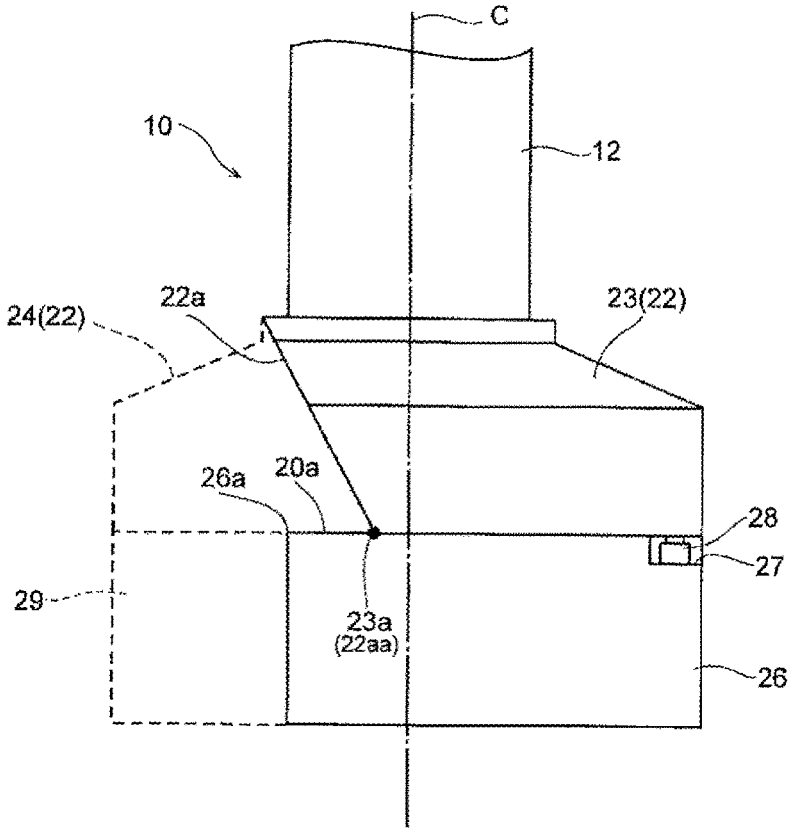
[Fig. 5]
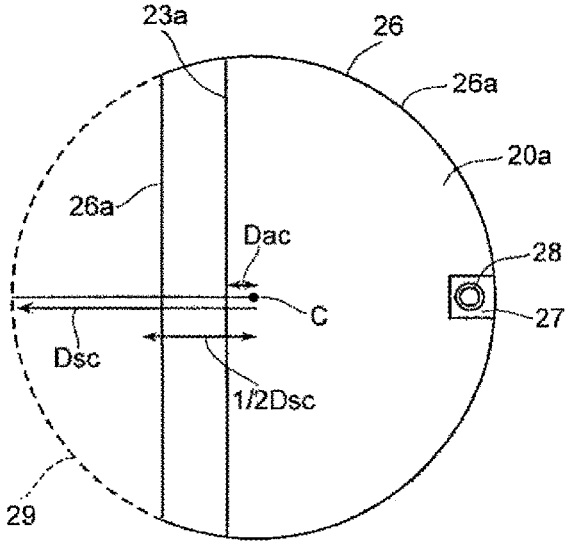

[Fig. 6]
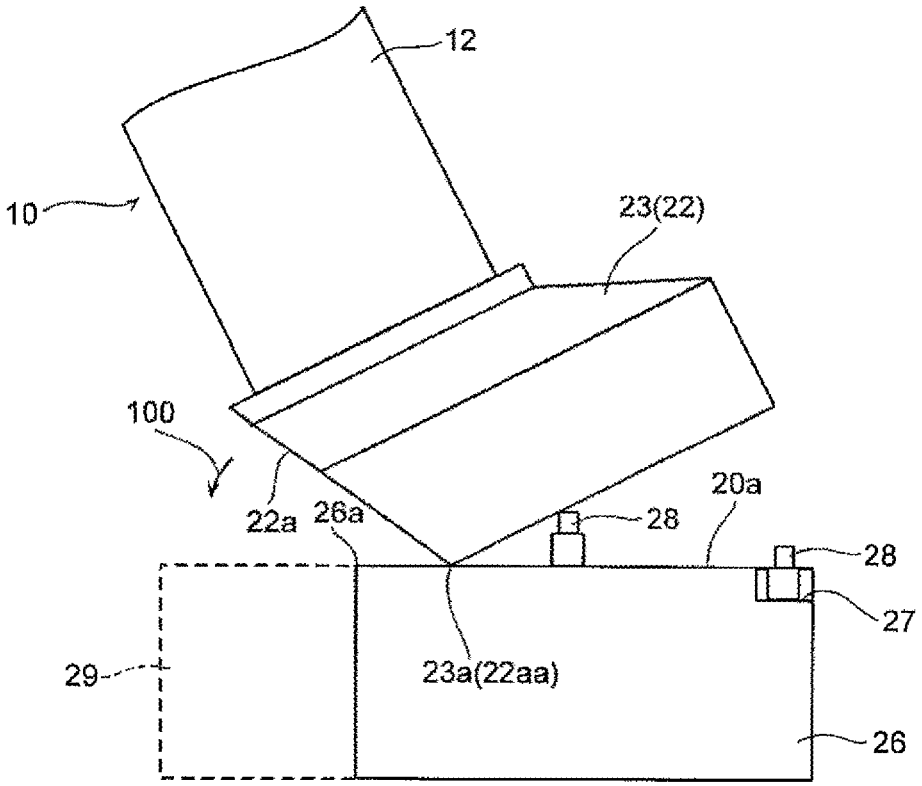

[Fig. 7]
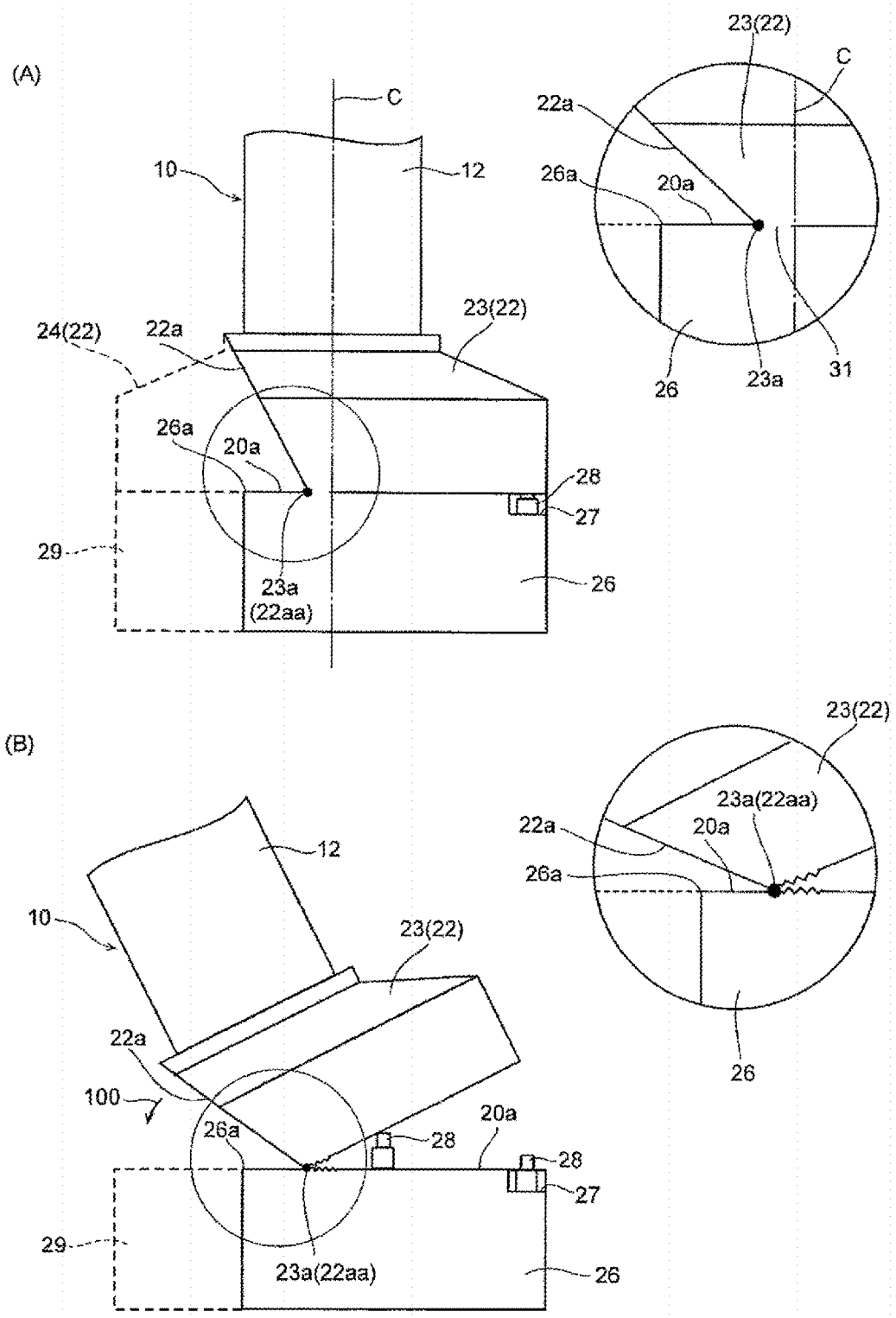

[Fig. 8]
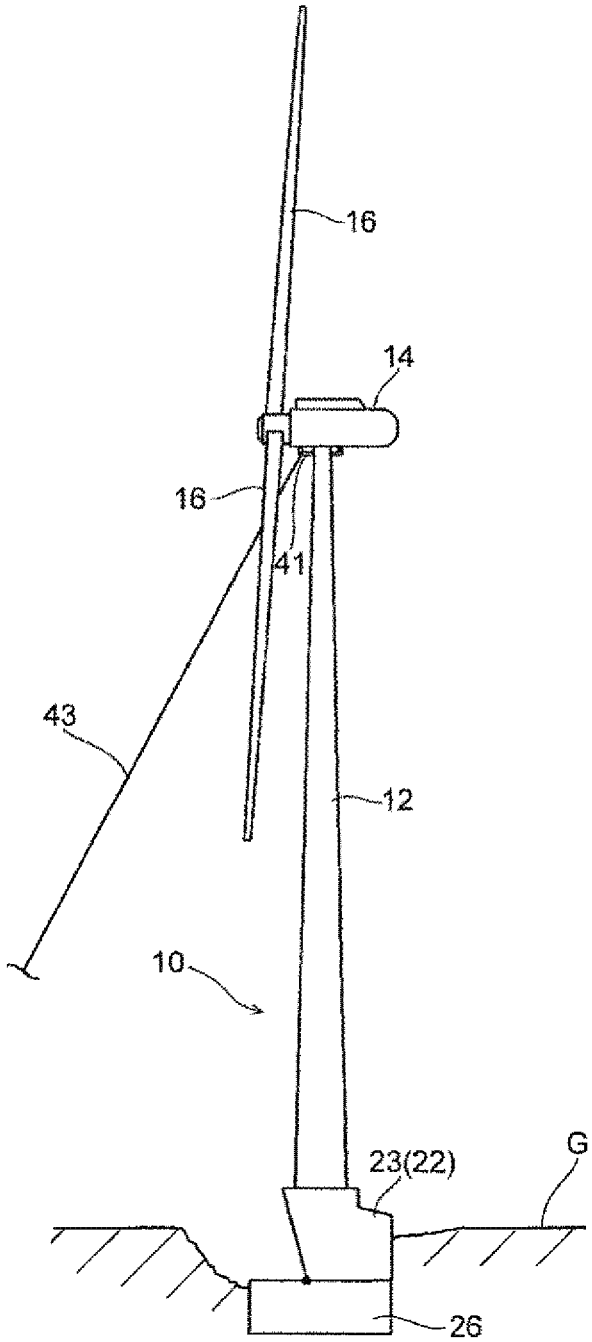

METHOD FOR TOPPLING TOWER BUILDING IN WHICH BASE IS USED

TECHNICAL FIELD

The present invention relates to a method of toppling a tower structure, and in particular to a method of toppling a tower structure fixedly supported on a base fixed to a ground to demolish the tower structure.

BACKGROUND ART

A structure is demolished and removed for various reasons such as the structure being aged or the need of reconstruction of another new structure. However, when the structure is a considerably high tower structure, the work would be extensive, requiring considerable time and labor. For example, when the tower structure is to be demolished, a scaffold, a crane and the like will be prepared, the tower structure will be cut into small pieces from the top toward the base, the cut pieces will be carried to the ground using the crane or the like, and then the base supporting the tower structure will be demolished.

To quickly and easily accomplish a demolishing work of such a tower structure, the invention disclosed in Patent Literature 1 has been proposed in which a tower structure is toppled and demolished.

More specifically, a method of toppling and demolishing a heat storage chamber of a heat blast furnace which is a tower structure comprises pouring a hardener into an air-venting portion at a lower portion of the heat storage chamber to reinforce an upper region at a lowermost position of the heat storage chamber, removing a foundation portion forming a lowermost position on a toppling direction side of the heat storage chamber to the extent that the heat storage chamber can maintain a self-standing state, and applying a force to the heat storage chamber in the toppling direction to topple the heat storage chamber.

According to the demolishing method disclosed in Patent Literature 1, the heat storage chamber can be toppled safely and securely in a direction in which the foundation portion is removed, that is, in an intended toppling direction, and then the tower structure can be demolished on the ground all at once. In this way, there is no need of a crane or a scaffold to be built and even the demolishing work can be accomplished rapidly after the heat storage chamber is toppled.

CITATION LIST

Patent Literature

Patent Literature 1: Japanese Patent No. 4790357

SUMMARY OF INVENTION

Technical Problem

However, according to the demolishing method disclosed in Patent Literature 1, when a force is applied to the heat storage chamber in the toppling direction to topple the heat storage chamber, an upper region at the lowermost position of the heat storage chamber, which is in contact with the foundation, serves as a tumble fulcrum to concentrate a buckling load on the tumble fulcrum, leading to a buckling. Consequently, the heat storage chamber may be toppled in a different toppling direction from the intended toppling direction. The upper region at the lowermost position of the heat storage chamber, which is in contact with the foundation, forms an air-venting portion, which is generally a portion of low strength.

Therefore, in the demolishing method disclosed in Patent Literature 1, since it is necessary to prevent the heat storage chamber from being toppled in a direction different from the intended toppling direction, a hardener is poured into this air-venting portion to harden and reinforce the tumble fulcrum, thereby preventing the above-described buckling.

A problem of the buckling of the tumble fulcrum with the demolishing method disclosed in Patent Literature 1 is not limited to a case where the heat storage chamber is demolished. That is, when the method disclosed in Patent Literature 1 is used to demolish the tower structure, since as the height of the tower structure increases, the mass of the tower structure increases, the buckling load applied to the tumble fulcrum of the tower structure increases. In the case of the heat storage chamber in Patent Literature 1, the hardener can be filled into a space of the air-venting portion present in the tumble fulcrum. However, depending on the type of the tower structure, it may be difficult to strengthen the tumble fulcrum. If the strength of the tumble fulcrum is insufficient, the tower structure may be toppled in a direction different from the intended direction, which is dangerous.

In addition, filling the hardener to strengthen the tumble fulcrum requires time and labor for hardening. Accordingly, there has been a need for a method of toppling the tower structure more simply.

The present invention has been made in view of the above problems, and an object of the present invention is to provide a method of toppling a tower structure more simply and quickly.

Solution to Problem

To achieve the object, the invention according to claim 1 provides a method of toppling a tower structure that is fixedly supported on a base fixed to a ground to demolish the tower structure, the method including a base dividing step of dividing the base into an upper base that is fixed to the tower structure and a lower base that is fixed to a ground, by cutting the base in a substantially horizontal direction, an upper base dividing step of dividing the upper base into a support base portion on which the tower structure is fixedly supported and a separated base portion that is separated from the tower structure by cutting the upper base, in a longitudinal direction, from above to a substantially horizontal surface created by the cutting in the substantially horizontal direction, a removing step of removing the separated base portion, and a toppling step of toppling the tower structure together with the support base portion using, as a tumble axis, a lower edge of a longitudinally cut surface created by cutting the support base portion in the longitudinal direction, wherein the tumble axis is located on a toppling direction side of the tower structure with respect to a center of gravity of the tower structure when viewed in an axial direction of the tumble axis.

According to this configuration, the base is divided into the upper base and the lower base, the upper base is divided into the support base portion on which the tower structure is fixedly supported and the separated base portion to remove the separated base portion, and the support base portion is toppled around the tumble axis, whereby the tower structure can be toppled simply and quickly.

At this time, since the tumble axis (tumble fulcrum) is formed by the robust base, the tumble axis can be held even when a buckling load is concentrated on the tumble axis, whereby the tower structure can be toppled in an intended direction, which ensures safety.

In addition, since the robust base serves as a tumble fulcrum by itself, the tower structure can be toppled without the need to reinforce the tumble fulcrum and more simply and quickly than the conventional toppling method which requires a reinforcement of the tumble fulcrum.

Furthermore, since the tumble axis is located on the toppling direction side of the tower structure with respect to the center of gravity of the tower structure when viewed in the axial direction of the tumble axis, the tower structure can stand by itself after the removing step, and therefore this can prevent unexpected natural toppling of the tower structure after the removing step, which ensures safety.

In the invention according to claim 2, the longitudinally cut surface has an oblique cross section which gradually approaches a center-of-gravity side of the tower structure as it extends from above to below, in the method of toppling a tower structure according to claim 1.

According to this configuration, since the tumble axis can be closer to the center of gravity of the tower structure, the tower structure can be toppled more easily than a case where the longitudinally cut surface is substantially perpendicular.

In the invention according to claim 3, a shortest distance from the center of gravity of the tower structure to the tumble axis in the substantially horizontal surface is equal to or smaller than ½ of a shortest distance from the center of gravity to a side surface portion of the base in the substantially horizontal surface, in the method of toppling a tower structure according to claim 1 or 2.

According to this configuration, since the tumble axis is located at a position relatively closer to the center-of-gravity position of the tower structure in the substantially horizontal surface, a center-of-gravity movement distance in the toppling step is reduced, and the tower structure transitions to the natural toppling due to the own weight, immediately. Therefore, the tower structure can be toppled more simply and rapidly with a smaller force.

In the invention according to claim 4, a continuous portion in which the lower base and the support base portion are not completely disconnected is provided in a region including the tumble axis and a vicinity of the tumble axis, and a strength of the continuous portion is a strength sufficient to break the continuous portion in a process of toppling of the tower structure in the toppling step, in the method of toppling a tower structure according to any one of claim 1 or 3.

According to this configuration, since the lower base and the support base portion are connected with each other by the continuous portion in an early stage of the toppling step, shifting of the tumble axis in the early stage of the toppling step can be prevented. In the intermediate stage or later of the toppling step, the continuous portion breaks by the turning of the support base portion around the tumble axis, whereby the tower structure can be toppled. In this way, the tower structure can be toppled in the intended direction more securely.

In the invention according to claim 5, the toppling step includes a push-up operation of pushing up a bottom surface of the support base portion by a push-up means provided on the lower base after the base dividing step, in the method of toppling a tower structure according to any one of claim 1 or 4.

According to this configuration, the lower base can be used as a reaction force receiving surface as it is by providing the push-up means on the lower base, and a force for toppling the tower structure can be exerted by the simple operation of pushing up the bottom surface of the support base portion.

In the invention according to claim 6, a partially removing step of the lower base of removing a part of the lower base on the toppling direction side of the tower structure with respect to the tumble axis is provided between the removing step and the toppling step, in the method of toppling a tower structure according to any one of claim 1 or 5.

According to this configuration, when the tower structure is toppled in the toppling step, the support base portion can drop into a region in which a part of the lower base has been removed, whereby the tower structure can be toppled in the intended direction more securely.

Advantageous Effects of Invention

According to the present invention, the base is divided into the upper base and the lower base, the upper base is divided into the support base portion on which the tower structure is fixedly supported and the separated base portion to remove the separated base portion, and the support base portion is toppled around the tumble axis, whereby the tower structure can be toppled simply and quickly.

At this time, since the tumble axis (tumble fulcrum) is formed by the robust base, the tumble axis can be held even when a buckling load is concentrated on the tumble axis, whereby the tower structure can be toppled in an intended direction, which ensures safety.

In addition, since the robust base serves as a tumble fulcrum by itself, the tower structure can be toppled without the need to reinforce the tumble fulcrum and more simply and quickly than the conventional toppling method which requires a reinforcement of the tumble fulcrum.

Furthermore, since the tumble axis is located on the toppling direction side of the tower structure with respect to the center of gravity of the tower structure when viewed in the axial direction of the tumble axis, the tower structure can stand by itself after the removing step, and therefore this can prevent unexpected natural toppling of the tower structure after the removing step, which ensures safety.

BRIEF DESCRIPTION OF DRAWINGS

FIG. 1 is a side view illustrating a tower structure according to an embodiment of the present invention.

FIG. 2 is a diagram illustrating a base dividing step of the method of toppling the tower structure according to the present embodiment.

FIG. 3 is a diagram illustrating an upper base dividing step and a removing step of the method of toppling the tower structure according to the present embodiment.

FIG. 4 is a diagram illustrating a partially removing step of a lower base of the method of toppling the tower structure according to the present embodiment.

FIG. 5 is a top plan view of a substantially horizontal surface 20*a* of a lower base 26 after the partially removing step of the lower base of the method of toppling the tower structure according to the present embodiment.

FIG. 6 is a diagram illustrating a toppling step of the method of toppling the tower structure according to the present embodiment.

FIG. 7 is a diagram illustrating a variant example of the present embodiment, in which FIG. 7(A) is a view after the removing step, and FIG. 7(B) illustrates the toppling step.

FIG. 8 is a diagram illustrating another example of the toppling step.

DESCRIPTION OF EMBODIMENTS

Figure 9:
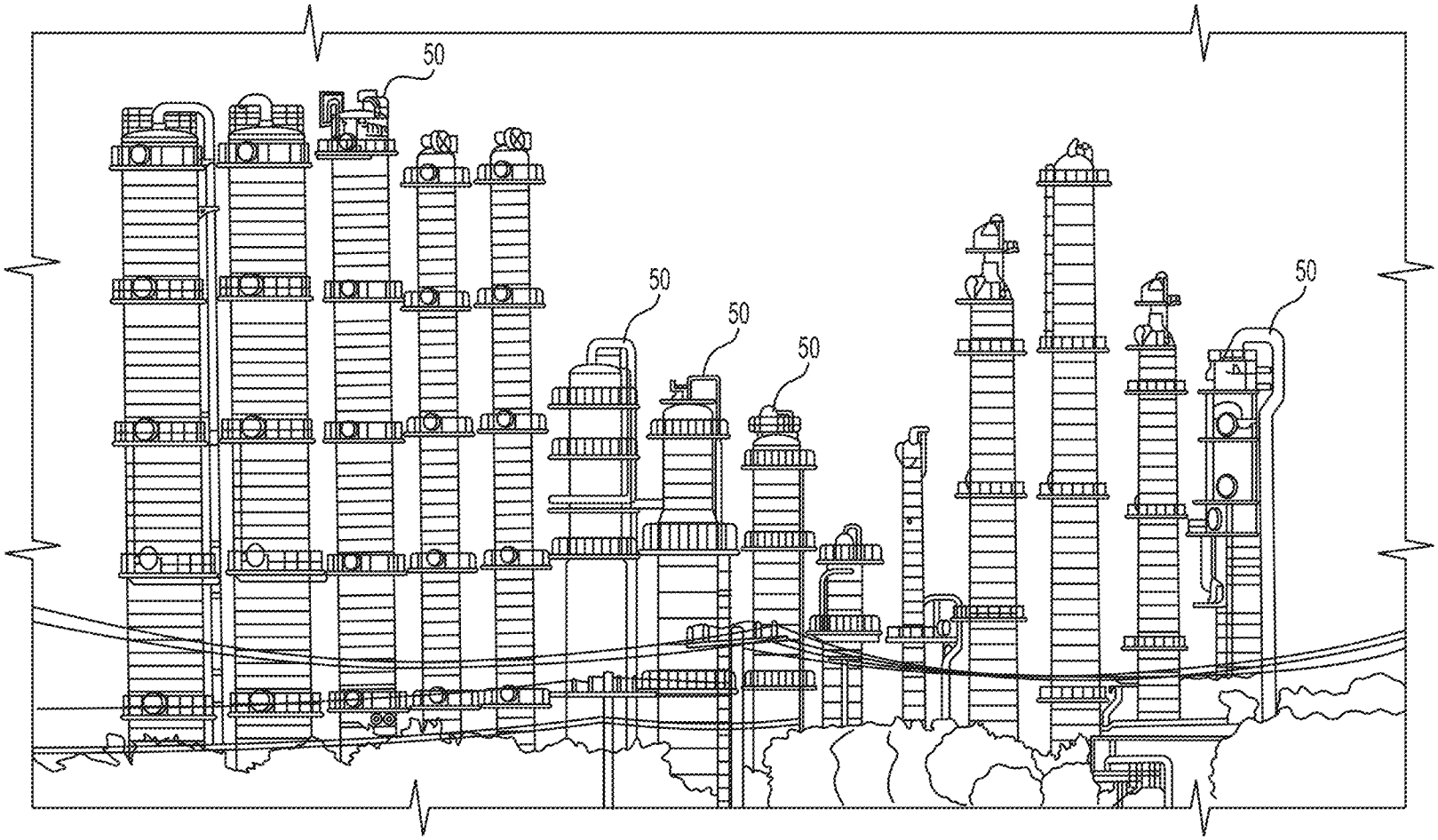
FIG. 9 is a diagram illustrating a distillation tower 50 as another example of the tower structure.

Next, embodiments of the present invention will be described in detail based on the drawings. A method of toppling a tower structure that is fixedly supported on a base fixed to a ground to demolish the tower structure will be described with referent to FIG. 1 to FIG. 6. FIG. 1 is a side view illustrating a tower structure according to an embodiment of the present invention, FIG. 2 is a diagram illustrating a base dividing step of the method of toppling the tower structure, FIG. 3 is a diagram illustrating an upper base dividing step and a removing step, FIG. 4 is a diagram illustrating a partially removing step of a lower base, FIG. 5 is a top plan view of a substantially horizontal surface 20*a* of a lower base 26 after the partially removing step of the lower base, and FIG. 6 is a diagram illustrating a toppling step.

As illustrated in FIG. 1, in the present embodiment, a tower structure 10 is a wind turbine for power generation including a nacelle 14 and blades 16 which are provided at an upper end of a tower 12. As will be described later, the tower structure of the present invention is not limited to a wind turbine for power generation.

The tower structure 10 is fixedly supported on a base 20 made of reinforced concrete via the tower 12. The base 20 is firmly fixed to piles (not illustrated) driven into a ground G. That is, the base 20 is firmly fixed on the ground G via the piles which are a part of the base 20. Note that the piles are not necessarily provided, and can be arbitrarily selected according to the type of the ground G and the height of the tower structure.

Next, each step of the method of toppling the tower structure of the present invention will be described. The method of toppling the tower structure of the present invention includes a base dividing step, an upper base diving step, a removing step, and a toppling step.

[Base Dividing Step]

The base dividing step will be described with reference to FIG. 2. As illustrated in FIG. 2, the base 20 is cut into two in the substantially horizontal direction. The cutting can be performed using a wire saw, for example.

The base 20 is divided into an upper base 22 and a lower base 26 by a substantially horizontal surface 20*a* created by the cutting in the substantially horizontal direction. The substantially horizontal surface 20*a* need not be perfectly horizontal, and may have a slightly oblique cross section (this concludes the description of the base dividing step).

[Upper Base Dividing Step]

Next, the upper base dividing step will be described with reference to FIG. 3. As illustrated in FIG. 3, the upper base 22 is cut from above to the substantially horizontal surface 20*a* in a longitudinal direction. The upper base may be cut in a substantially vertical direction. However, in the present embodiment, the upper base 22 is actually cut in an oblique direction, and therefore a longitudinally cut surface 22*a* after cutting has an oblique cross section which gradually approaches a center-of-gravity C side of the tower structure 10 as it extends from above to below, as illustrated in FIG. 3. The longitudinally cut surface 22*a* divides the upper base 22 into a support base portion 23 on which the tower structure 10 is fixedly supported and a separated base portion 24 which is separated from the tower structure 10 (this concludes the description of the upper base dividing step).

[Removing Step]

The separated base portion 24 is removed before the toppling step. One end of a wire rope (not illustrated) is fixed to the separated base portion 24, and the other end of the wire rope is towed by a winch or a vehicle, so that the separated base portion 24 can be removed. The fixing of the one end of the wire rope to the separated base portion 24 is achieved by providing a U-shaped hook, an L-shaped hook or the like on the surface of the separated base portion 24 by which the one end of the wire rope is anchored therein, for example.

After the separated base portion 24 is removed, a boundary line (a lower edge 22*aa* of the longitudinally cut surface 22*a*) between the substantially horizontal surface 20*a* and the longitudinally cut surface 22*a* in the support base portion 23 serves as a tumble axis 23*a*, as will be described later in the toppling step. It is preferable that the tumble axis 23*a* is located on a toppling direction side (the left side in the drawing) of the tower structure 10 with respect to the center of gravity C of the tower structure 10 in a side view, as illustrated in FIG. 3 (this concludes the description of the removing step).

[Partially Removing Step of Lower Base]

In this step, a part of the lower base 26 on the toppling direction side of the tower structure 10 with respect to the tumble axis 23*a* is removed. In the present embodiment, as illustrated in FIG. 4, the lower base 26 is cut in the longitudinal direction from a position 26*a* on the toppling direction side of the tower structure 10 with respect to the tumble axis 23*a*, and a cut portion 29 of the lower base 26 is removed. The removal of the cut portion 29 can be performed in a similar manner as the removal of the separated base portion 24.

Note that the cut portion 29 to be removed is set so that a length from the position 26*a* to the tumble axis 23*a* on the substantially horizontal surface 20*a* is smaller than the length of the longitudinally cut surface 22*a*. This is because the tower structure 10 can be toppled in the intended direction more securely, as will be described later.

In addition, in the present embodiment, a push-up means is provided on the lower base 26 after the base dividing step. For example, a jack can be used for the push-up means 28.

For example, as illustrated in FIG. 4, a recess 27 is formed by cutting the lower base 26 from the side surface thereof, and the push-up means 28 is provided in the recess 27 (this concludes the description of the partially removing step of the lower base).

FIG. 5 is a top plan view of the lower base 26 after the partially removing step of the lower base, but as illustrated in FIG. 5, a shortest distance $D_{ac}$ from the center of gravity C of the tower structure 10 to the tumble axis 23*a* in the substantially horizontal surface 20*a* is smaller than ½ of a shortest distance $D_{sc}$ (that is, ½ $D_{sc}$) from the center of gravity C to a side surface portion 26*a* of the base 20 (26) before the partially removing step in the substantially horizontal surface 20*a*. Note that the above-described shortest distance $D_{ac}$ is preferably ½ $D_{sc}$ or less, and particularly preferably ⅓ $D_{sc}$ or less.

In the present embodiment, the magnitude of $D_{ac}$ is compared with the magnitude of ½ $D_{sc}$ when the substantially horizontal surface 20*a* has a circular cross section. However, even when the shape of the substantially horizontal surface 20*a* is another shape such as a square shape, a hexagonal shape, a four angle star-like shape, the above-described relationship in magnitude between $D_{ac}$ and ½ $D_{sc}$ is similarly applied.

[Toppling Step]

Next, the toppling step will be described with reference to FIG. 6. In this step, as illustrated in FIG. 6, the support base portion 23 is turned around the tumble axis 23*a* in a direction in which the longitudinally cut surface 22*a* of the support base portion 23 approaches the substantially horizontal surface 20*a* of the lower base 26, and the tower structure 10 is toppled together with the support base portion 23.

The toppling step includes a push-up operation of pushing up a bottom surface 23*b* (a cross section 20*a*) of the support base portion 23 by the push-up means 28. As illustrated in FIG. 6, the push-up operation causes the support base portion 23 to be turned in a direction of an arrow 100, whereby the tower structure 10 is toppled together with the support base portion 23.

Note that after the pushed-up height of the push-up means 28 provided in the recess 27 becomes maximum during the push-up operation, another push-up means 28 is further provided on the lower base 26 as illustrated in FIG. 6, and the push-up operation is performed again, so that the tower structure 10 can be completely toppled (this concludes the description of the toppling step).

Therefore, according to the method of toppling the tower structure according to the present embodiment, the base 20 is divided into the upper base 22 and the lower base 26, the upper base 22 is divided into the support base portion 23 on which the tower structure 10 is fixedly supported and the separated base portion 24 to remove the separated base portion 24, and the support base portion 23 is toppled around the tumble axis 23*a*, whereby the tower structure 10 can be toppled simply and quickly.

At this time, since the tumble axis 23*a* (tumble fulcrum) is formed by the robust base 20, the tumble axis 23*a* can be held even when a buckling load is concentrated on the tumble axis 23*a*, whereby the tower structure 10 can be toppled in the intended direction, which ensures safety.

In addition, since the robust base 20 serves as a tumble fulcrum by itself, the tower structure 10 can be toppled without the need to reinforce the tumble fulcrum and more simply and quickly than the conventional toppling method which requires a reinforcement of the tumble fulcrum.

Furthermore, as illustrated in FIG. 3 and FIG. 4, since the tumble axis 23*a* is located on the toppling direction side (the left side in the drawing) of the tower structure 10 with respect to the center of gravity C of the tower structure 10 when viewed in the axial direction of the tumble axis 23*a*, the tower structure 10 can stand by itself after the removing step. Therefore, this can prevent unexpected natural toppling of the tower structure 10 after the removing step, which ensures safety.

In addition, since the longitudinally cut surface 22*a* has an oblique cross section which gradually approaches the center-of-gravity C side of the tower structure 10 as it extends from above to below, the tumble axis 23*a* can be closer to the center of gravity C of the tower structure 10. Therefore, the tower structure 10 can be toppled more easily than a case where the longitudinally cut surface 22*a* is substantially perpendicular to the substantially horizontal surface 20*a*.

In addition, since the shortest distance $D_{ac}$ from the center of gravity C of the tower structure 10 to the tumble axis 23*a* in the substantially horizontal surface 20*a* is equal to or smaller than ½ of the shortest distance $D_{sc}$ from the center of gravity C to the side surface portion 26*a* of the base 20 (26) in the substantially horizontal surface 20*a*, the tumble axis 23*a* is located at a position closer to the center of gravity C in the substantially horizontal surface 20*a*, the center-of-gravity movement distance in the toppling step is reduced, and the tower structure 10 transitions to the natural toppling due to the own weight, immediately. Therefore, the tower structure 10 can be toppled more simply and rapidly with a lower force.

Furthermore, since the toppling step includes a push-up operation by the push-up means 28, the lower base 26 can be used as a reaction force receiving surface as it is by providing the push-up means 28 on the lower base 26, and the tower structure 10 can be toppled by the simple operation of pushing up the bottom surface of the support base portion 23.

In addition, when the tower structure 10 is toppled in the toppling step, the support base portion 23 can drop into a region in which a part (the cut portion 29) of the lower base 26 has been removed, whereby the tower structure 10 can be toppled in the intended direction more securely.

Note that the present invention is not limited to the above-described embodiment, and can be modified in various ways without departing from the gist of the invention. For example, in the above-described embodiment, the lower base 26 is completely separated from the support base portion 23, but even after the partially removing step of the lower base, the lower base 26 need not be completely separated from the support base portion 23.

FIG. 7 is a diagram illustrating a variant example of the present embodiment, in which FIG. 7(A) is a view after the partially removing step of the lower base, and FIG. 7(B) illustrates the toppling step. In FIG. 7, components similar to those of the above-described embodiment are denoted by the same reference numerals, and description thereof is omitted.

As illustrated in FIG. 7(A), in the variant example, even after the partially removing step of the lower base, the lower base 26 and the support base portion 23 are not completely disconnected, and a portion adjacent to the tumble axis 23*a* on the center-of-gravity C side is a continuous portion 31 in which both of the lower base 26 and the support base portion 23 are connected.

The strength of the continuous portion 31 is a strength sufficient to break the continuous portion 31 in a process of toppling of the tower structure 10 in the toppling step. Therefore, a tensile force in an up-down direction acts on the continuous portion 31 along with the push-up operation by the push-up means 28 in the toppling step, and the continuous portion 31 breaks as illustrated in FIG. 7(B).

According to the continuous portion 31, since the continuous portion 31 connects between the lower base 26 and the support base portion 23 in an early stage of the toppling step, shifting of the tumble axis 23*a* (for example, the support base portion 23 is turned in the direction around an axis of the center of gravity C with respect to the lower base 26, or the like) in the early stage of the toppling step can be prevented. In the intermediate stage or later of the toppling step, the continuous portion 31 breaks by the turning of the support base portion 23 around the tumble axis 23*a*, whereby the tower structure 10 can be toppled. In this way, the tower structure 10 can be toppled in the intended direction more securely.

In the above-described embodiment, the push-up operation by the push-up means 28 causes the support base portion 23 to be turned in the direction of the arrow 100, whereby the tower structure 10 is toppled. However, the present invention is not limited thereto, and the tower structure 10 may be toppled by another operation.

FIG. 8 is a diagram illustrating another example of the toppling step. As illustrated in FIG. 8, a hook 41 is provided on a lower portion of the nacelle 14, and one end of a wire rope 43 is fixed to the hook 41.

Then, the support base portion 23 may turned around the tumble axis 23*a* in a direction in which the longitudinally cut surface 22*a* of the support base portion 23 approaches the substantially horizontal surface 20*a* of the lower base 26 by towing the other end of the wire rope 43, to topple the tower structure 10. Note that in a variant example of FIG. 8, the partially removing step of the lower base is not performed, but such a variant example is included in the method of toppling the tower structure of the present invention.

A pulling operation using the wire rope 43 and the push-up operation by the push-up means 28 may be used in combination.

Figure 10:
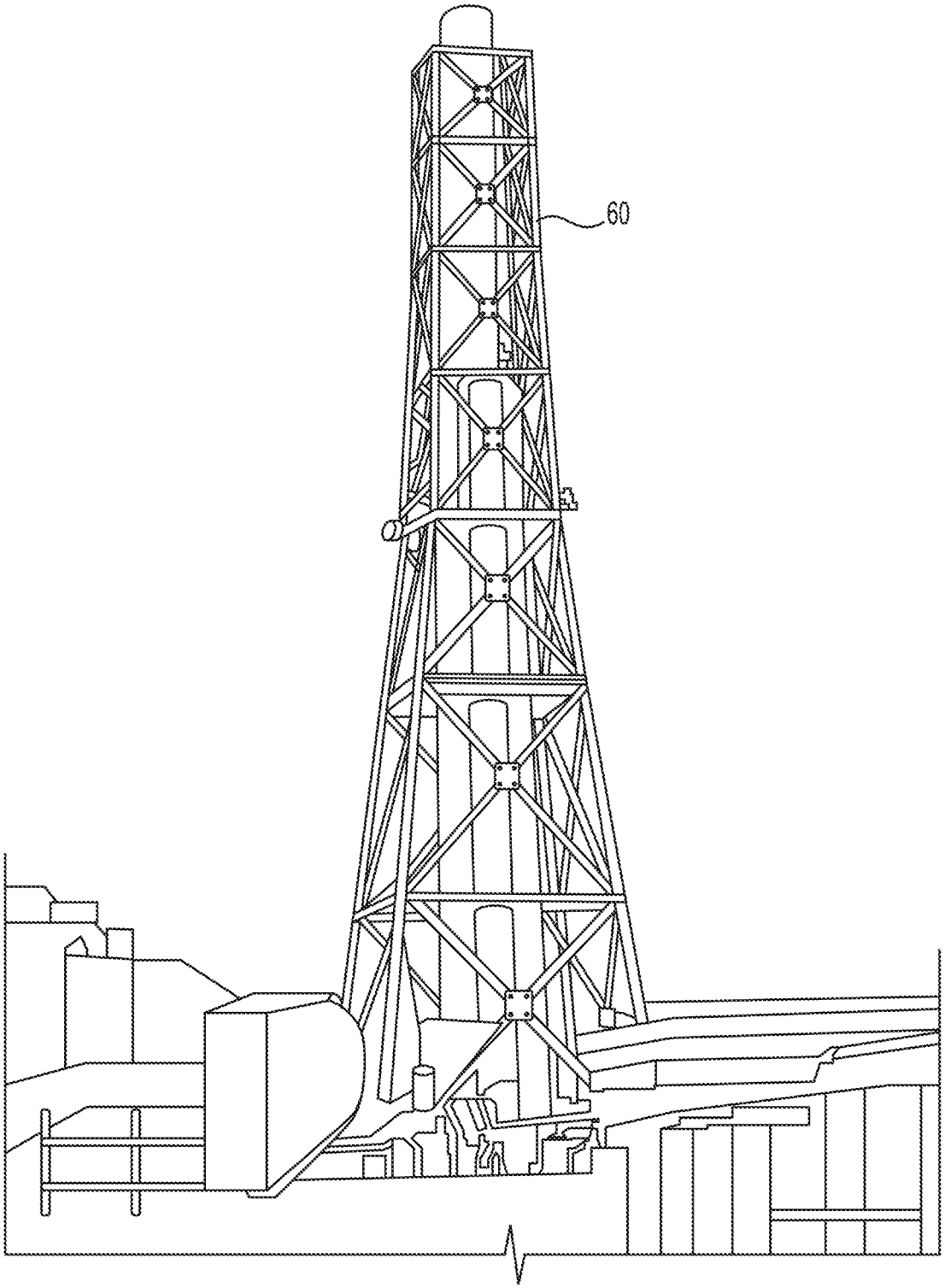
FIG. 10 is a diagram illustrating a smokestack 60 as another example of the tower structure.
Figure 11:
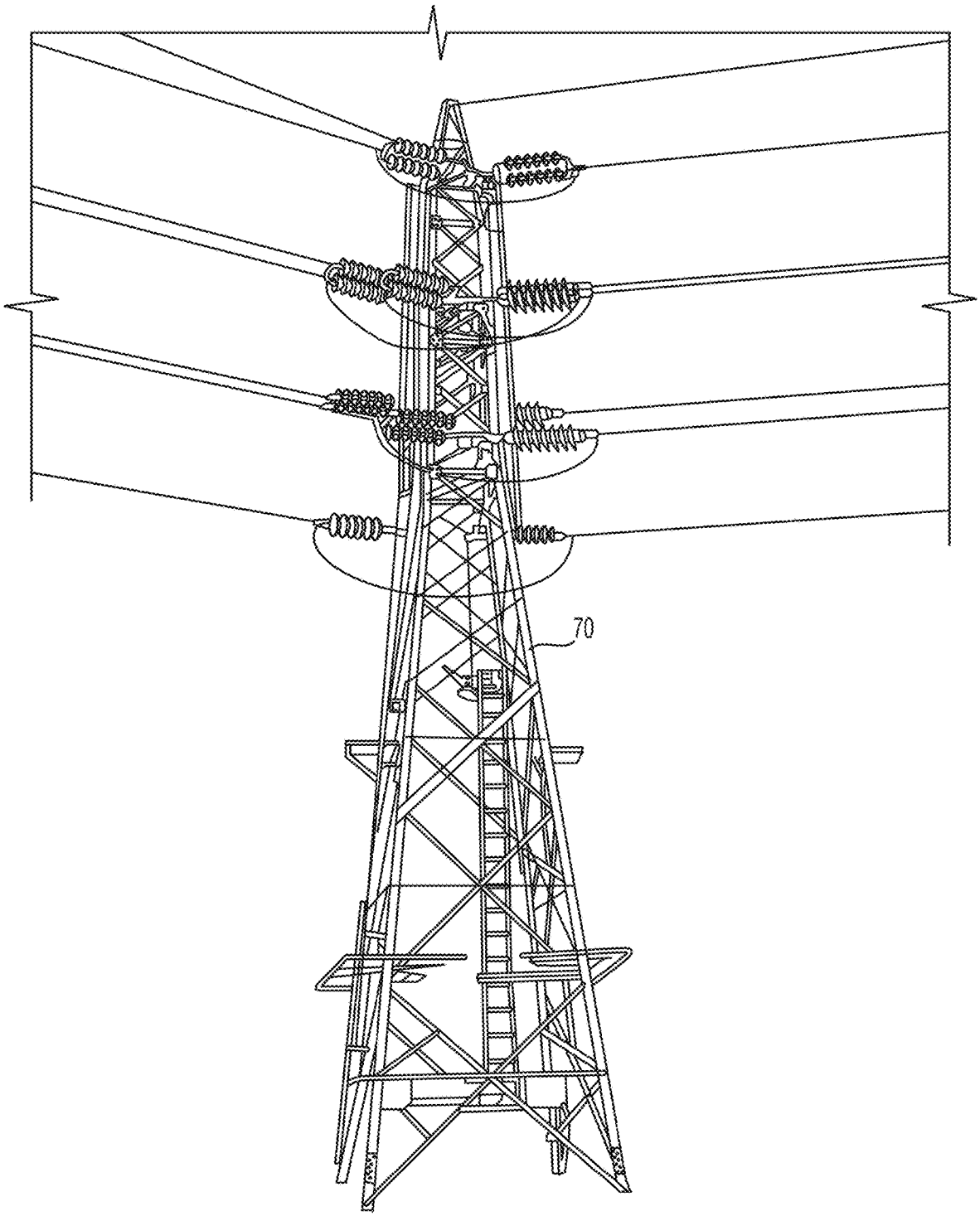
FIG. 11 is a diagram illustrating an electrical transmission tower 70 as another example of the tower structure.
Figure 12:
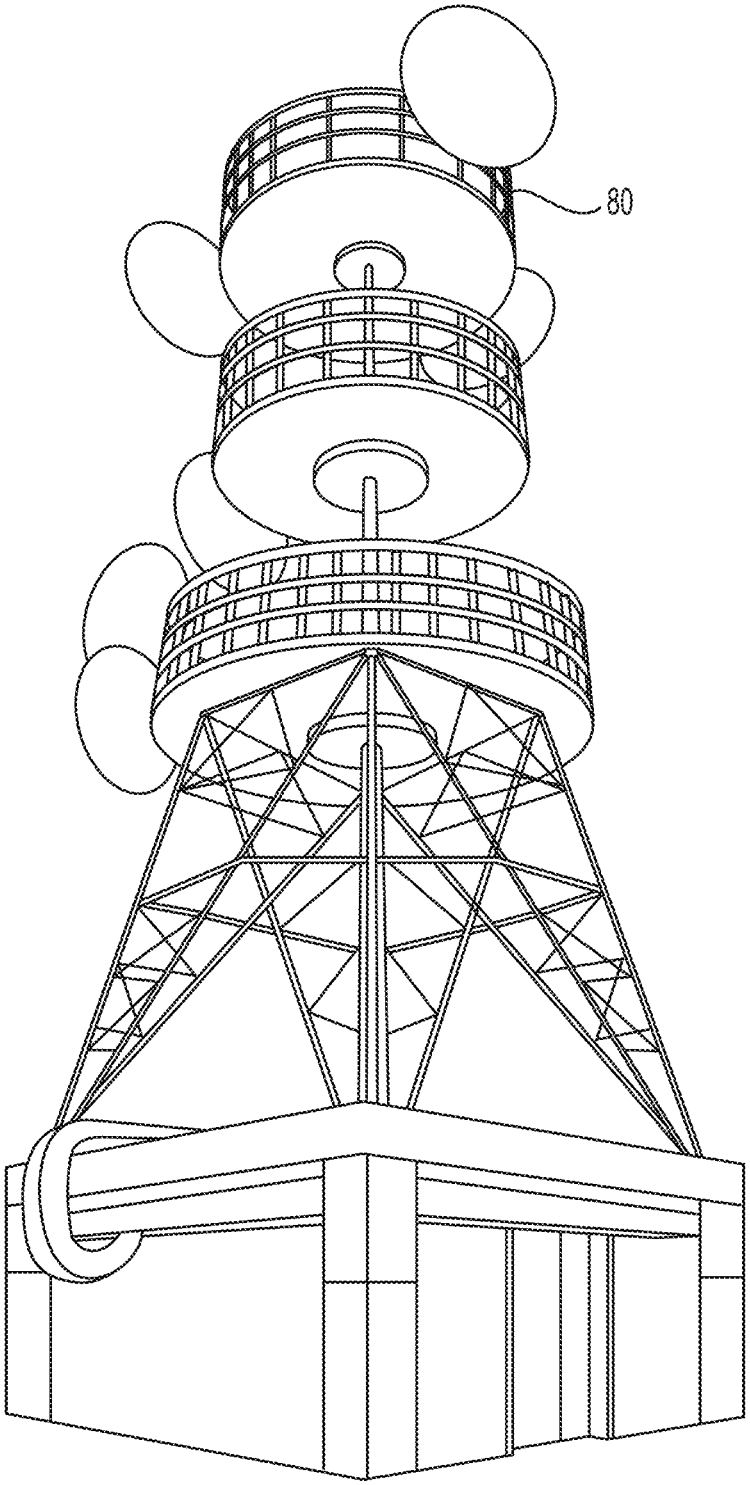
FIG. 12 is a diagram illustrating a broadcast tower 80 as another example of the tower structure.
Figure 13:
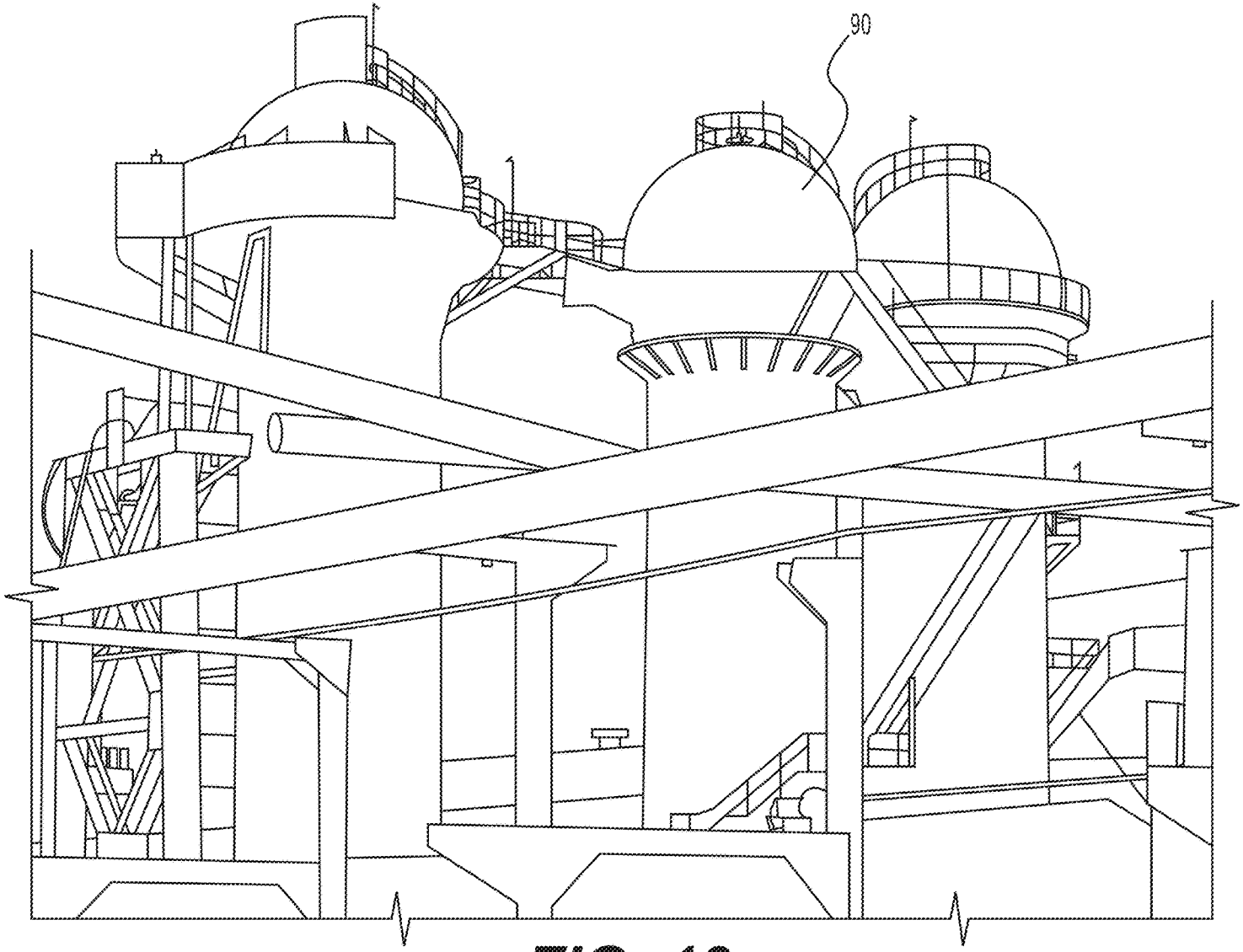
FIG. 13 is a diagram illustrating a heat blast furnace 90 as another example of the tower structure.

Furthermore, in the above-described embodiment, a wind turbine for power generation is shown as an example of the tower structure, but the present invention is not limited thereto. The tower structure can be any tower structure having a base. Examples of the tower structure include, a distillation tower 50 (FIG. 9), a smokestack 60 (FIG. 10), an electrical transmission tower 70 (FIG. 11), a broadcast tower 80 (FIG. 12), a heat blast furnace 90 (FIG. 13), a bridge pier, a tower building, and other various tower structures.

In addition, the method of toppling the tower structure of the present invention can be also applied to a plurality of tower structures provided on one base. That is, the tumble axes are formed by cutting one base, so that the plurality of tower structures can be toppled together with the one base by turning the plurality of tower structures around the respective tumble axes.

REFERENCE SIGNS LIST

10 Tower structure
20 Base
22 Upper base
23 Support base portion
23*a* Tumble axis
24 Separated base portion
26 Lower base
28 Push-up means
31 Continuous portion

The invention claimed is:

1. A method of toppling a tower structure that is fixedly supported on a base fixed to a ground to demolish the tower structure, the method comprising:

a base dividing step of dividing the base into an upper base that is fixed to the tower structure and a lower base that is fixed to a ground, by cutting the base in a substantially horizontal direction;

an upper base dividing step of dividing the upper base into a support base portion on which the tower structure is fixedly supported and a separated base portion that is separated from the tower structure by cutting the upper base, in a longitudinal direction, from above to a substantially horizontal surface created by the cutting in the substantially horizontal direction;

a removing step of removing the separated base portion; and a toppling step of toppling the tower structure together with the support base portion using, as a tumble axis, a lower edge of a longitudinally cut surface created by cutting the support base portion in the longitudinal direction, wherein the tumble axis is located on a toppling direction side of the tower structure with respect to a center of gravity of the tower structure when viewed in an axial direction of the tumble axis.

2. The method of toppling a tower structure according to claim 1, wherein the longitudinally cut surface has an oblique cross section which gradually approaches a center-of-gravity side of the tower structure as it extends from above to below.

3. The method of toppling a tower structure according to claim 1, wherein a shortest distance from the center of gravity of the tower structure to the tumble axis in the substantially horizontal surface is equal to or smaller than ½ of a shortest distance from the center of gravity to a side surface portion of the base in the substantially horizontal surface.

4. The method of toppling a tower structure according to claim 1, wherein a continuous portion in which the lower base and the support base portion are not completely disconnected is provided in a region including the tumble axis and a vicinity of the tumble axis, and a strength of the continuous portion is a strength sufficient to break the continuous portion in a process of toppling of the tower structure in the toppling step.

5. The method of toppling a tower structure according to claim 1, wherein the toppling step includes a push-up operation of pushing up a bottom surface of the support base portion by a push-up means provided on the lower base after the base dividing step.

6. The method of toppling a tower structure according to claim 1, wherein a partially removing step of the lower base of removing a part of the lower base on the toppling direction side of the tower structure with respect to the tumble axis is provided between the removing step and the toppling step.

* * * * *